United States Patent [19]

Katoh et al.

[11] Patent Number: 4,592,243

[45] Date of Patent: Jun. 3, 1986

[54] REDUCTION TYPE STARTER

[75] Inventors: Kazunori Katoh; Yasuhiro Nagao, both of Kariya, Japan

[73] Assignee: Nippondenso Co., Ltd., Kariya, Japan

[21] Appl. No.: 613,405

[22] Filed: May 24, 1984

[30] Foreign Application Priority Data

Jun. 20, 1983 [JP] Japan ..... 58-110401
Mar. 13, 1984 [JP] Japan ..... 59-48375

[51] Int. Cl.[4] ..... F02N 15/06
[52] U.S. Cl. ..... 74/7 E; 74/7 R; 74/7 A
[58] Field of Search ..... 74/6, 7 R, 7 A, 7 E, 74/7 C; 290/38 C, DIG. 1

[56] References Cited

U.S. PATENT DOCUMENTS 1,156,869 10/1915 Walker ..... 74/7 E
1,441,418 1/1923 Halbleib ..... 74/7 E
1,916,173 6/1933 Lansing ..... 74/7 C
3,771,372 11/1973 Asahi et al. ..... 74/7 R

FOREIGN PATENT DOCUMENTS 5812471 6/1977 Japan .

*Primary Examiner*—Allan D. Herrmann
*Attorney, Agent, or Firm*—Cushman, Darby & Cushman

[57] ABSTRACT

A reduction type starter, wherein an idle shaft is mounted in a starter housing in parallel with a motor shaft and a pinion drive shaft, and an over running clutch is provided on the idle shaft so that a reduction of rotational speed can be performed at two stages.

7 Claims, 3 Drawing Figures

REDUCTION TYPE STARTER

BACKGROUND OF INVENTION

1. Field of Invention

The present invention relates to a reduction-type starter for an internal combustion engine, more particularly to a starter of the reduction-type having a motor shaft, an idle shaft and a pinion drive shaft, wherein a reduction of rotation is performed in this order and at two stages and wherein an over-running clutch is provided on the idle shaft.

2. Brief Description of Prior Art

Two kinds of reduction-type starters are known in the art, that is, a reduction-type starter wherein an over-running clutch is provided on a pinion drive shaft, and a starter wherein the over-running clutch is provided on a motor shaft. In the starter, a transmitting torque applied to the clutch is a value obtained by multiplying the torque of a starter motor by a reduction ratio, while the moment of inertia of the starter motor has an influence on the clutch by the self-multiplication of the reduction ratio Accordingly, in the former conventional starter, a clutch having a large capacity is required since the torque applied to the clutch is high, resulting in a drawback that the reduction in weight can not be realized. Further, it is disadvantageous in that the outer diameter of the clutch may be inevitably increased unless the module is decreased at the sucrifice of the mechanical strength of the reduction gear, in a case that the reduction ratio is intended to be made greater for the conventional starter employing the outer ring of the clutch as the reduction gear.

In the latter conventional starter, for example, as disclosed in Japanese Examined Patent Publication No. 58-12471, according to which the over-running clutch is provided directly on the motor shaft to decrease the transmitting torque applied to the clutch and to reduce the influence on the clutch by the moment of inertia of the starter motor, the rotational speed of the starter motor is so high, above 20,000 rpm, that the conventional clutch may not be used.

SUMMARY OF INVENTION

It is therefore an object of the present invention to provide a reduction-type starter, wherein an over-running clutch is provided on an idle shaft reduced in its rotation to an intermediate value and a reduction of rotational speed is performed at two stages, so that a torque applied to the clutch is decreased to make the clutch smaller in size.

According to the present invention, the rotational speed of the clutch can be selected at an intermediate value and modules of reduction gears can be designed in accordance with the respective reduction ratios.

DETAILED DESCRIPTION OF PREFERRED EMBODIMENTS

The present invention will now be explained with reference to the drawings showing embodiments of the present invention.

Figure 1:
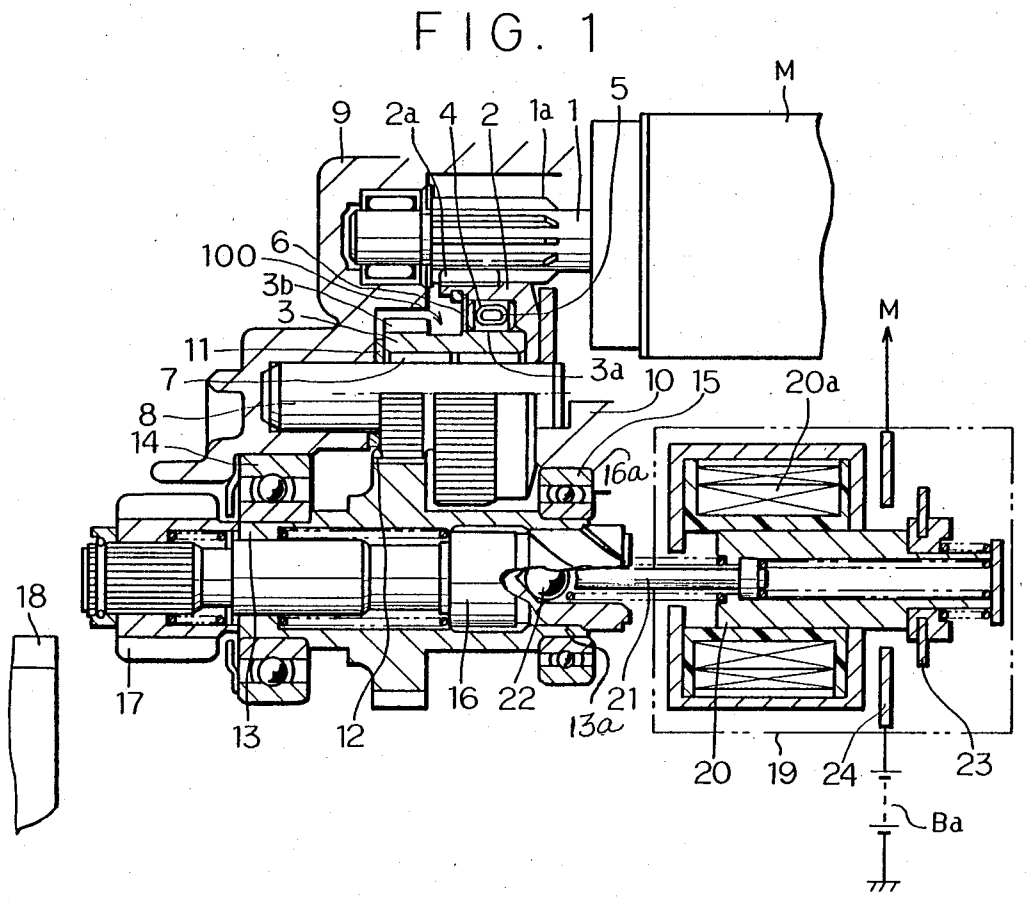
FIG. 1 is a sectional view showing a principal portion of a reduction-type starter according to a first embodiment of the present invention.

In FIG. 1, showing a first embodiment, numeral 1 designates a motor shaft of a starter motor M, a forward end of which is rotatably supported by a starter housing 9. A (motor) gear 1*a* is formed on the motor shaft 1.

Numeral 100 designates an over-running clutch having an outer ring 2, an inner ring 3, plural rollers 4, plural roller-springs 5, a washer 6 and bearings 7. Numeral 8 designates an idle shaft fixed to the housing 9 and the over-running clutch 100 is provided on the idle shaft 8. The outer ring 2 of a cup-shape is rotatably supported on the idle shaft 8 and is formed with a gear portion (first reduction gear) 2*a* at its outer periphery so that the gear portion 2*a* is engaged with the gear 1*a* of the motor shaft 1. The inner ring 3 is rotatably supported on the shaft 8 by means of the bearings 7 and is formed on its outer periphery with an inner race surface 3*a* at its one end and with a gear portion (second reduction gear) 3*b* at its other end. The rollers 4 and the springs 5 are inserted into the respective cam chambers formed by the outer ring 2 and the inner ring 3, and they are retained in the chambers by the washer 6. The over-running clutch 100 transmits the rotational force from the motor shaft to the inner ring 3 and the rotational speed is reduced depending on a reduction ratio between the gear 1*a* and the gear portion 2*a*. In the present embodiment, the reduction ratio is set at 2.

Numeral 11 designates a washer interposed between the inner ring 3 of the clutch and the housing 9.

Numeral 13 designates a spline tube rotatably supported by the housing 9 and a center bearing holder 10 through a pair of bearings 14 and 15. A drive gear 12 is formed on an outer periphery of the spline tube 13 and is engaged with the gear portion 3*b* of the over-running clutch 100.

Numeral 16 designates a spline shaft (pinion drive shaft) 16 inserted into the spline tube 13 and is engaged therewith through helical splines 13*a* and 16*a*, so that the spline shaft 16 is rotatably and slidably supported within the spline tube 13.

Numeral 17 designates a pinion mounted on a forward end of the spline shaft 16 and is brought into engagement with a ring gear 18 of an engine when the starter is operated.

Numeral 19 designates a magnet switch arranged coaxially with the spline shaft 16. The magnet switch 19 includes a plunger 20 axially slidably held within a solenoid coil 20*a*, so that the plunger 20 is pulled into when the solenoid coil 20*a* is energized. Numeral 21 designates a rod operatively connected to the plunger 20, one end of which is engaged with the spline shaft 16 through a ball 22 held in a bore formed in the shaft 16. When the magnet switch 19 is energized through an ignition key switch (not shown), the plunger 20 is pulled into and thereby the spline shaft 16 is pushed in a forward direction so as to engage the pinion 17 with the ring gear 18. At the same time, a movable contact 23 fixed to the plunger 20 is brought into engagement with a fixed contact 24, so that electric power is supplied to the starter motor M from a battery Ba through the closed contacts 23 and 24 to start the starter motor M.

When the starter motor M begins to rotate, its rotational force is transmitted from the motor shaft 1 to the pinion 17 through the gear portion 2*a* of the outer ring 2, the gear portion 3*b* of the inner ring 3, the drive gear 12 of the spline tube 13 and the spline shaft 16, wherein a first reduction of the rotational speed is performed between the gear 1*a* of the motor shaft 1 and the gear portion 2*a* of the outer ring 2 of the over-running clutch, while the second reduction is performed between the gear portion 3*b* of the inner ring 3 of the over-running clutch and the drive gear 12 of the spline tube 13.

When the rotational speed of the engine exceeds that of the pinion 17 after the engine is started, the rotational force of the engine is transmitted in a reverse direction to that of starting the engine, so long as the pinion 17 is engaged with the ring gear 18. However, this rotational force is not transmitted to the starter motor M by means of the over-running clutch 100, so that the starter motor M is prevented from being broken due to its over rotation.

Assuming that in the above described embodiment the first reduction ratio between the gear 1*a* of the motor shaft 1 and the gear portion 2*a* of the outer ring 2 of the over-running clutch 100 is set at 2, while the second reduction ratio between the gear portion 3*b* of the inner ring 3 and the drive gear 12 is set at 2.5, the total reduction ratio becomes 5. In this case, mechanical strength required for the over-running clutch should be designed not for the reduction ratio of 5 but for the reduction ratio of 2. When comparing the reduction-type starter with a conventional starter (not a reduction-type) having the same output, the weight of the reduction-type is less than that of the conventional-type, whereby the mechanical strength required for the clutch of the reduction-type may be almost the same as that of the conventional-type. On the other hand, the rotational speed of the clutch of the conventional-type is around 10,000 rpm during a running under no load, while the rotational speed of the starter motor of the reduction-type is around 20,000 rpm, that is, the rotational speed of the clutch of the reduction-type is around 10,000 rpm. Accordingly, the over-running clutch of the conventional-type can be also used in the reduction-type starter, when the over-running clutch is provided on the idle shaft. Namely, the clutch can be commonly used to the reduction-type and the conventional-type, and therefore the clutch for the reduction-type of the present invention may be so small as that for the conventional type.

As another advantage of the present invention, a required mechanical strength of the gear can be easily obtained since the setting of the gear (reduction) ratio is free and the modules for the gear on the motor shaft and the drive gear on a pinion drive shaft (the spline tube in the above embodiment) can be independently designed because the reduction of the rotational speed is performed at two stages.

When the starter motor of 1.0 Kw starts to rotate, an impulsive force of about 10 Kg.m is produced. The following Table shows the impulsive forces on the pinion and on the over-running clutch, depending on a position of the over-running clutch

| | | Reduction Ratio | Impulsive Force on pinion | Impulsive Force Applied to Clutch | Motor Speed | Clutch Speed |
|---|---|---|---|---|---|---|
| Present Embodiment | | 5 (Motor → 2 Clutch → 2.5 → Pinion →) | 10 Kg · m | 4 Kg · m (10 1/2.5) | 20000 rpm | 10000 rpm |
| Example 1 | Clutch is formed on Drive Shaft | 5 | 10 Kg · m | 10 Kg · m | 20000 rpm | 4000 rpm |
| Example 2 | Clutch is formed on Motor Shaft | 5 | 10 Kg · m | 2 Kg · m (10 1/5) | 20000 rpm | 20000 rpm |

As in the above Table, the impulsive force equal to the impulsive force of 10 Kg.m to the pinion is applied to the clutch in Example 1, while in the present embodiment the impulsive force of 4 Kg.m divided by the second reduction ratio of 2.5 is applied to the clutch. In Example 2, the impulsive force of 2 Kg.m divided by its reduction ratio of 5 is applied to the clutch. It is meant here that the smaller the impulsive force applied to the clutch, the smaller in size and in weight the clutch. In the clutch of this kind, the rotational speed of 13,000–15,000 rpm is the upper limit. Contrary to that, since the rotational speed of the clutch in Example 2 is equal to that of the motor and about 20,000 rpm, a generally-used clutch can not be used. According to the present embodiment, the rotational speed is 10,000 rpm and the generally-used clutch can be used. With respect to the clutch performance of the conventional type starter having the same output, the impulsive force is 4 Kg.m and the rotational speed is 10,000 rpm. The clutch can be therefore used to the conventional type and to the reduction type, whereby the clutch low in cost and in weight can be advantageously used.

In the above described embodiment, the inner ring 3 can be omitted, when the idle shaft 8 is rotatably supported by the housing 9 and the inner race surface 3*a* and the gear portion 3*b* are formed directly on the outer periphery of the idle shaft.

Figure 2:
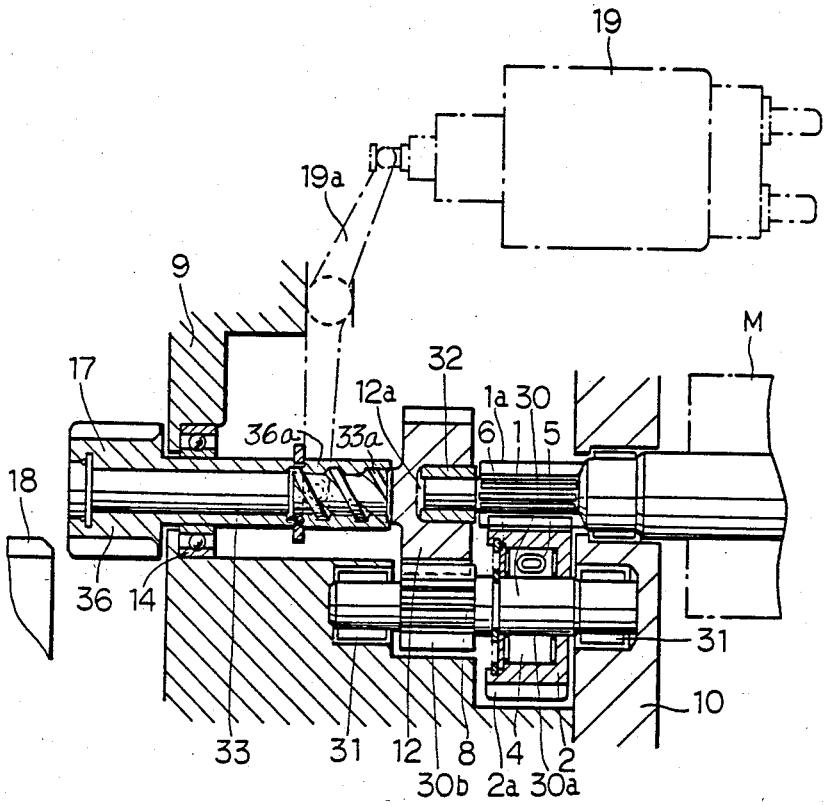
FIG. 2 is a sectional view showing a principal portion of the second embodiment.

In FIG. 2, showing a second embodiment, the same reference numerals designate the same or the similar element or construction to that of the above-described first embodiment, and therefore the explanation of those elements is omitted.

In the second embodiment, the starter motor M is coaxially arranged with a pinion drive shaft. The pinion drive shaft is constituted by a spline tube 36 in this embodiment, which is rotatably and slidably supported by the housing 9 by means of the bearing 14. The pinion 17 is formed at the forward end of the spline tube 36. The spline tube 36 is driven by the magnet switch 19 to move in the forward direction by a lever 19*a*. A spline shaft 33 is inserted into the spline tube 36 and is engaged therewith through helical spline 33*a* and 36*a*. The drive gear 12 is formed at one end of the spline shaft. A bore 12*a* is formed at its end, into which the forward end of the motor shaft 1 is inserted and the motor shaft 1 is rotatably supported by a bearing 32.

Numeral 30 designates an idle shaft rotatably supported by the housing 9 and the center bearing holder 10 by means of a pair of bearings 31. The inner race surface 30*a* and the gear portion 30*b* of the over-running clutch are directly formed on the outer periphery of the idle shaft 30.

Figure 3:
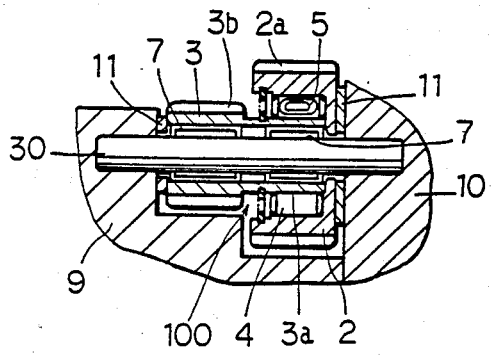
FIG. 3 is a sectional view showing a modification of the second embodiment.

FIG. 3 shows a modification of the second embodiment, wherein the idle shaft 30 is fixed to the housing 9 and the center bearing holder 10 as in the first embodiment. The over-running clutch 100 in FIG. 3 is therefore the same as that of the first embodiment shown in FIG. 1.

In the above described second embodiment, the whole construction of the starter can be made smaller in size and in weight, since the pinion drive shaft (spline tube) and the motor shaft are coaxially arranged, and the idle shaft is arranged in parallel with those shafts. Additionally, since the pinion is coaxially arranged with the motor shaft of the starter motor, the shape of the starter becomes apparently similar to that of the conventional starter and thereby it is possible to ensure an exchangeability with the conventional starter.

What is claimed is:

1. A reduction type starter comprising:
a starter housing;
a starter motor having a motor shaft;
a motor gear formed on said motor shaft;
a pinion drive shaft rotatably and slidably supported by said housing;
a pinion attached to one end of said pinion drive shaft;
a drive gear operatively coupled to said pinion drive shaft;
an idle shaft fixed to said housing and in parallel with said motor shaft and said pinion drive shaft; and
an over-running clutch provided on said idle shaft, said clutch having an outer ring formed with a first reduction gear being engaged with said motor gear, said clutch also having an inner ring formed with a second reduction gear being engaged with said drive gear.

2. A reduction-type starter as set forth in claim 1, further comprising:
a magnet switch coaxially arranged with said pinion drive shaft.

3. A reduction-type starter as set forth in claim 1, wherein
said motor shaft is coaxially arranged with said pinion drive shaft.

4. A reduction-type starter comprising:
a starter housing;
a starter motor having a motor shaft;
a motor gear formed on said motor shaft;
an idle shaft fixed to said starter housing in parallel with said motor shaft;
an over-running rotatably provided on said idle shaft, said clutch having an outer ring formed with a first reduction gear at its outer periphery, said first reduction gear being engaged with said motor gear, said clutch further having an inner ring formed with a second reduction gear at its outer periphery;
a spline tube rotatably supported by said starter housing and having a drive gear at its outer periphery, said drive gear being engaged with said second reduction gear;
a spline shaft rotatably supported by said spline tube; and
a magnet switch coaxially arranged with said spline shaft.

5. A reduction-type starter comprising:
a starter housing;
a starter motor having a motor shaft;
a motor gear formed on said motor shaft;
a spline tube rotatably and slidably supported by said starter housing;
a spline shaft rotatably supported by and operatively coupled to said spline tube,
a drive gear formed at one end of said spline shaft;
an idle shaft rotatably supported by said starter housing in parallel with said motor shaft and said spline shaft; and
an over-running clutch provided on said idle shaft, said clutch having an outer ring formed with a first reduction gear at its outer periphery, said first reduction gear being engaged with said motor gear, said clutch also having a second reduction gear formed at the outer periphery of said idle shaft and engaged with said drive gear, said clutch having a roller and a spring disposed between said outer ring and the outer periphery of said idle shaft so as to transmit the rotational force from said outer ring to said idle shaft.

6. A reduction-type starter as set forth in claim 5 wherein
said motor shaft is coaxially arranged with said spline shaft.

7. A reduction type starter comprising:
a starter housing;
a starter motor having a motor shaft;
a motor gear formed on said motor shaft;
a spline tube rotatably and slidably supported by said starter housing;
a spline shaft rotatably supported by and operatively coupled to said spline tube;
a drive gear formed at one end of said spline shaft;
an idle shaft fixed to said starter housing in parallel with said motor shaft and said spline shaft; and
an over-running clutch provided on said idle shaft, said clutch having an outer ring formed with a first reduction gear at its outer periphery, said first reduction gear being engaged with said motor gear, said clutch also having an inner ring formed with a second reduction gear at its outer periphery, said second reduction gear being engaged with said drive gear.

* * * * *